US008018421B2

(12) United States Patent
Kuo

(10) Patent No.: US 8,018,421 B2
(45) Date of Patent: Sep. 13, 2011

(54) DRIVING CIRCUIT, GATE DRIVER AND LIQUID CRYSTAL DISPLAY HAVING THE SAME

(75) Inventor: Mao-Hsiung Kuo, Hsinhua (TW)

(73) Assignee: Himax Technologies Limited, Tainan (TW)

( * ) Notice: Subject to any disclaimer, the term of this patent is extended or adjusted under 35 U.S.C. 154(b) by 1217 days.

(21) Appl. No.: 11/237,826

(22) Filed: Sep. 29, 2005

(65) Prior Publication Data

US 2006/0109232 A1 May 25, 2006

(30) Foreign Application Priority Data

Nov. 19, 2004 (TW) ..... 93135769 A

(51) Int. Cl.
*G09G 3/36* (2006.01)

(52) U.S. Cl. ..... 345/100; 345/98

(58) Field of Classification Search ..... 345/87–104, 345/204; 377/64–81; 315/169.1–169.2
See application file for complete search history.

(56) References Cited

U.S. PATENT DOCUMENTS

| | | | | |
|---|---|---|---|---|
| RE33,882 | E * | 4/1992 | Morozumi | 345/88 |
| 5,808,883 | A * | 9/1998 | Hawkes | 363/60 |
| 6,115,017 | A * | 9/2000 | Mikami et al. | 345/92 |
| 6,879,313 | B1 * | 4/2005 | Kubota et al. | 345/100 |
| 2003/0001800 | A1 * | 1/2003 | Nakajima et al. | 345/55 |
| 2004/0150610 | A1 * | 8/2004 | Zebedee et al. | 345/100 |
| 2004/0174334 | A1 * | 9/2004 | Washio et al. | 345/102 |
| 2004/0183771 | A1 * | 9/2004 | Satoh et al. | 345/100 |
| 2004/0190672 | A1 * | 9/2004 | Lu et al. | 377/64 |
| 2005/0057556 | A1 * | 3/2005 | Kubota et al. | 345/211 |

* cited by examiner

*Primary Examiner* — Chanh Nguyen
*Assistant Examiner* — Long Pham
(74) *Attorney, Agent, or Firm* — Rabin & Berdo, P.C.

(57) ABSTRACT

A gate driver of a liquid crystal display includes classes of driving circuits coupled to each other for outputting gate pulses. At least one class of driving circuits includes a shift register and a switch. The shift register outputs the gate pulse corresponding to the class of driving circuit according to the gate pulse outputted by a former class of driving circuits. The switch controls the enable of the shift register according to the gate pulse outputted by the former class of driving circuit and the gate pulse outputted by the class of driving circuit.

11 Claims, 5 Drawing Sheets

DRIVING CIRCUIT, GATE DRIVER AND LIQUID CRYSTAL DISPLAY HAVING THE SAME

This application claims the benefit of Taiwan application Serial No. 93135769, filed Nov. 19, 2004, the subject matter of which is incorporated herein by reference.

BACKGROUND OF THE INVENTION

1. Field of the Invention

The invention relates in general to a liquid crystal display and driving circuit thereof, and more particularly to a liquid crystal display, in which a shift register in a class of driving circuit is controlled to enable according to an output signal of a former class of driving circuit and an output signal of the class of driving circuit in a gate driver, and driving circuit.

2. Description of the Related Art

FIG. 1A is a block diagram showing a conventional structure of a liquid crystal display. Referring to FIG. 1A, the liquid crystal display 100 includes a gate driver 110, a pixel matrix 120, a data driver 130 and a timing controller 140. The gate driver 110 includes a first shift register 112, a second shift register 112, . . . , and an n-th shift register 112, wherein n is a positive integer greater than 1. The p-th ($1 \leqq p \leqq n$) shift register 112 outputs a gate pulse Gp according to a clock signal CLK and a start pulse STP (p=1) outputted by the timing controller 140 or a gate pulse G(p−1) ($p \neq 1$), so as to turn on a p-th row of pixels (not shown) of the pixel matrix 120 to receive pixel data signals outputted by the data driver 130.

FIG. 1B is a diagram showing partial circuits of the shift register of FIG. 1A. Referring to FIG. 1B, the typical shift register 112 includes a logic device such as an inverter 114. The inverter 114 includes two N-type metal oxide semiconductor (NMOS) transistors T1 and T2. When the input signal Sin is at a high level, the transistor T2 is turned on such that the output signal Sout has a low level. When the input signal Sin is at a low level, the transistor T2 is turned off. At this time, because the gate of the transistor T1 is coupled to the drain of the transistor T1 to form an equivalent resistor, the operation voltage VDD of the shift register 112 boosts the output signal Sout to a high level, and the effect of signal inverting is thus generated.

However, the transistors T1 and T2 are a single type of NMOS design but not the complementary metal oxide semiconductor (CMOS) architecture. Thus, even if the transistor T2 is turned off, the transistor T2 still has a leakage current $I_L$ outputted by the operation voltage VDD. Because the gate driver 110 has the leakage current phenomenon in each class of shift register 112 during the operation, the power consumption of the liquid crystal display 100 is thus increased.

SUMMARY OF THE INVENTION

It is therefore an object of the invention to provide a liquid crystal display and driving circuit thereof. An operation voltage of one class of driving circuit is inputted to a shift register according to a gate pulse outputted by a former class of driving circuit and a gate pulse outputted by the class of driving circuit in a gate driver. Thus, the leakage current in each class of driving circuit can be reduced, and the power-saving effect of the liquid crystal display may be achieved.

The invention achieves the above-identified object by providing a driving circuit used in a gate driver. The driving circuit includes a shift register, a logic circuit and a switch. The shift register outputs a gate pulse according to a starting signal. The OR logic circuit outputs a control signal according to the starting signal and the gate pulse. The switch controls the enable of the shift register according to the control signal.

The invention also achieves the above-identified object by providing a gate driver including a first driving circuit and a second driving circuit. The first driving circuit includes a first shift register, a first logic circuit and a first switch. The first shift register outputs a first gate pulse according to a starting signal. The first logic circuit outputs a first control signal according to the starting signal and the first gate pulse. The first switch controls the enable of the first shift register according to the first control signal. In addition, the second driving circuit coupled to the first driving circuit includes a second shift register, a second logic circuit and a second switch. The second shift register outputs a second gate pulse according to the first gate pulse. The second logic circuit outputs a second control signal according to the first gate pulse and the second gate pulse. The second switch controls the enable of the second shift register according to the second control signal.

The invention also achieves the above-identified object by providing a gate driver including a first shift register and a first switch. The first shift register outputs a first gate pulse according to a starting signal. The first switch controls the enable of the first shift register according to the starting signal and the first gate pulse.

The invention also achieves the above-identified object by providing a liquid crystal display including a substrate, a gate driver, a pixel matrix and a data driver. The pixel matrix includes a plurality of pixels on the substrate. The data driver outputs a plurality of pixel data signals to the pixel matrix. The gate driver includes classes of driving circuits coupled to each other and outputs a plurality of gate pulses to sequentially drive the pixels. At least one of the classes of driving circuits includes a shift register and a switch. The shift register outputs the gate pulse corresponding to the class of driving circuit according to the gate pulse outputted by a former class of driving circuit. The switch controls the enable of the shift register according to the gate pulse outputted by the former class of driving circuit and the gate pulse outputted by the class of driving circuit.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
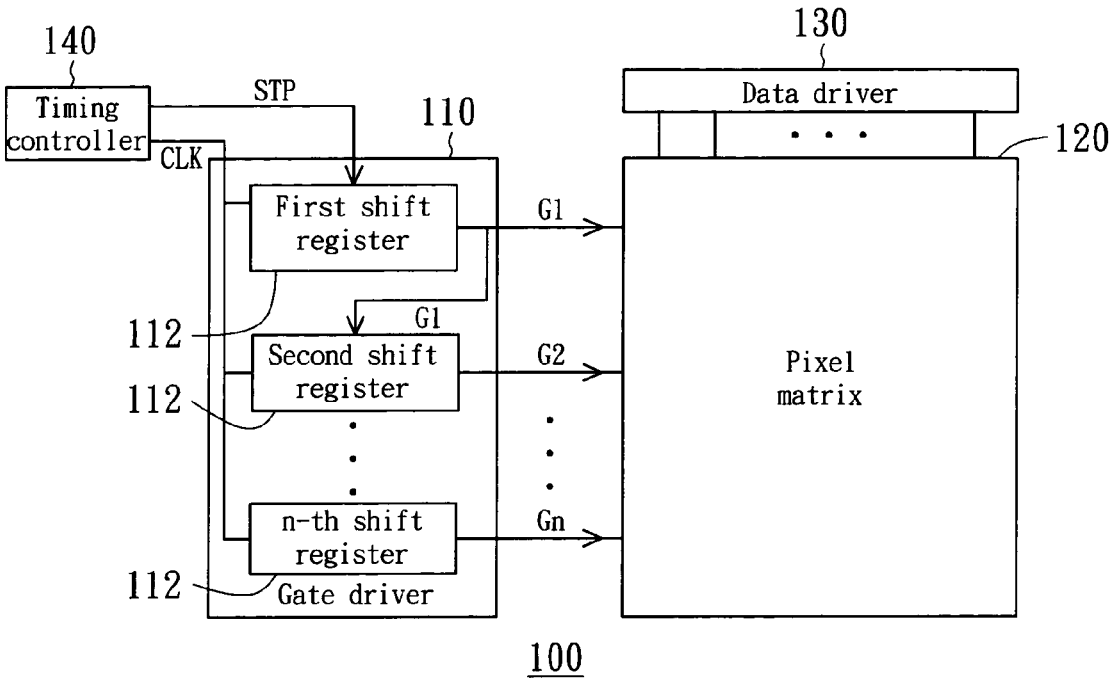
FIG. 1A(PRIOR ART)
FIG. 1A is a block diagram showing a conventional structure of a liquid crystal display.
Figure 1B:
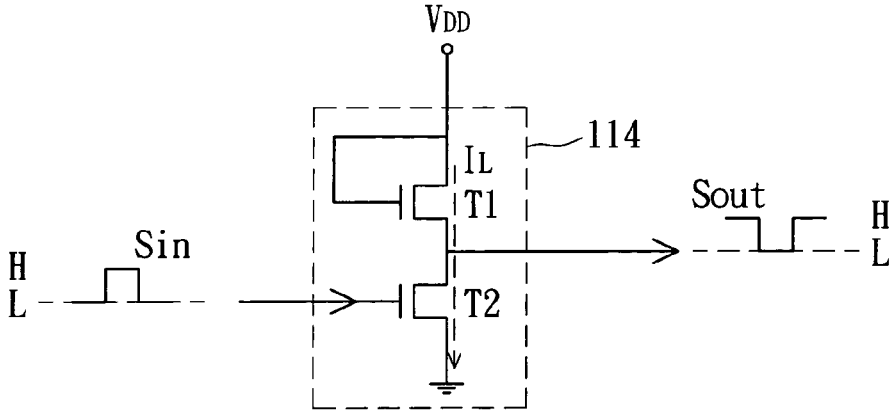
FIG. 1B(PRIOR ART)
FIG. 1B is a diagram showing partial circuits of the shift register of FIG. 1A.
Figure 2A:
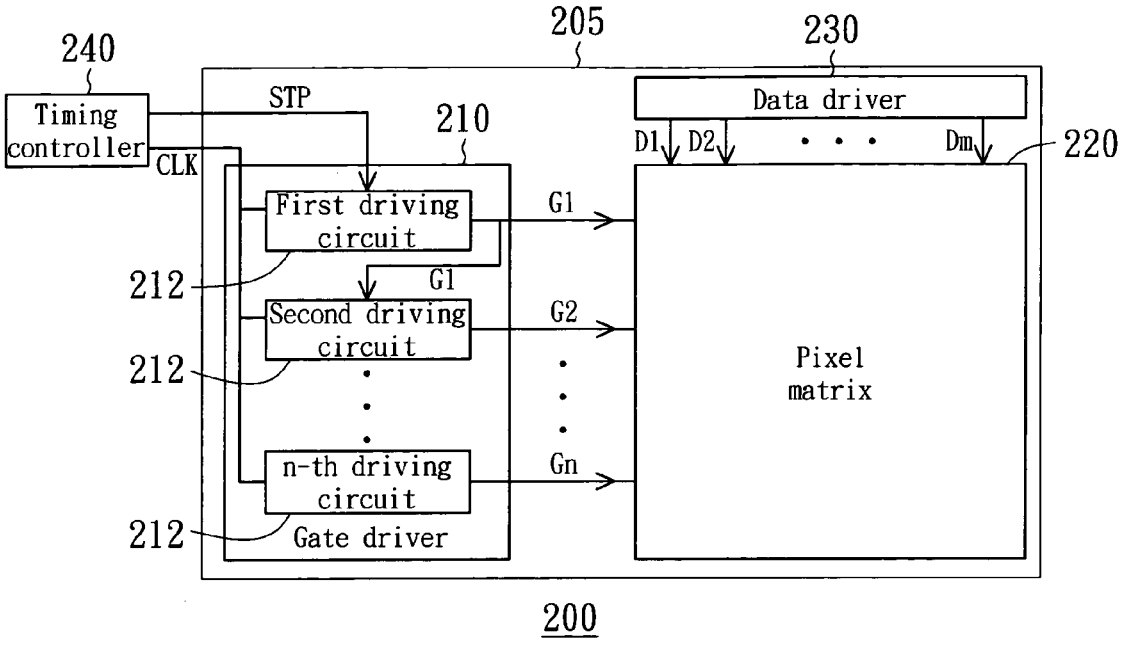
FIG. 2A is a block diagram showing circuits of a liquid crystal display according to a preferred embodiment of the invention.

FIG. 2A is a block diagram showing circuits of a liquid crystal display according to a preferred embodiment of the invention. Referring to FIG. 2A, the liquid crystal display 200 includes a substrate 205, a gate driver 210, a pixel matrix 220, a data driver 230 and a timing controller 240. The pixel matrix 220 is disposed on the substrate 205. The gate driver 210 includes n classes of driving circuits 212 coupled to each other. The classes of driving circuits 212 sequentially output n gate pulses G1 to Gn for driving each row of pixels (not shown) of the pixel matrix 220 to receive pixel data signals D1 to Dm outputted by the data driver 230, wherein m and n are positive integers greater than 1. The p-th driving circuit 212 outputs a gate pulse Gp to the pixel matrix 220 according to a clock signal CLK and a start pulse STP (p=1) outputted by the timing controller 240 or a gate pulse G(p−1) (p≠1) outputted by the (p−1)th driving circuit 212, wherein 1≦p≦n, and p is a positive integer.

When the pixel matrix 220 of the liquid crystal display 200 is composed of N-type transistors and the gate driver 210 and the pixel matrix 220 are to be integrated on the same substrate 205, it is an optimum condition that both of the gate driver 210 and the pixel matrix 220 are N-type transistors so as to reduce the number of manufacturing steps and cost. On the contrary, both of the gate driver 210 and the pixel matrix 220 are P-type transistors.

Figure 2B:
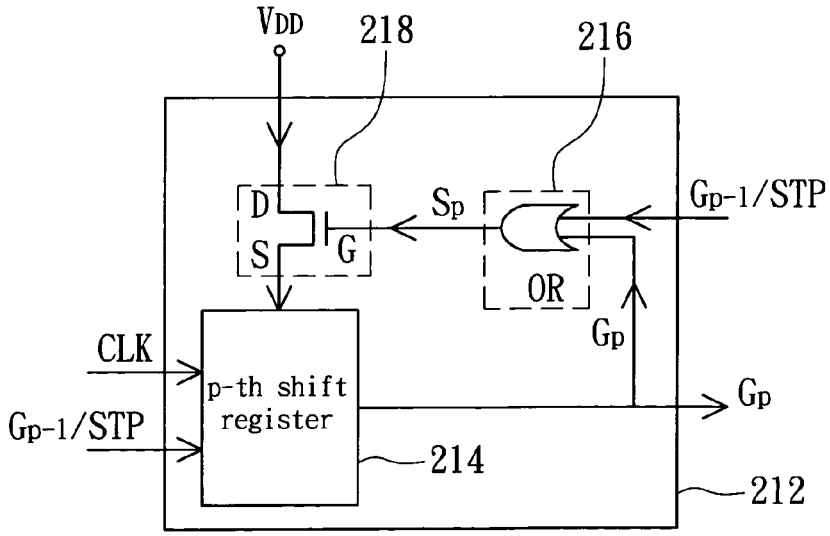
FIG. 2B is a block diagram showing circuits of the p-th driving circuit in FIG. 2A.

FIG. 2B is a block diagram showing circuits of the p-th driving circuit 212 in FIG. 2A. Referring to FIG. 2B, the p-th driving circuit 212 includes a p-th shift register 214, a p-th OR logic circuit 216 and a p-th switch 218. The p-th shift register 214 outputs a gate pulse Gp according to the clock signal CLK and a gate signal G(p−1) (p≠1) or the start pulse STP (p=1). The p-th OR logic circuit 216 outputs a control signal Sp according to the gate pulse Gp and the gate signal G(p−1) (p≠1) or the start pulse STP (p=1). The p-th switch 218 controls an operation voltage VDD to be inputted to the p-th shift register 214 according to the control signal Sp. The p-th switch 218 may be, for example a NMOS transistor having a gate G for receiving the control signal Sp, a drain D coupled to the operation voltage VDD, and a source S coupled to the p-th shift register 214. The p-th switch 218 controls the enable of the p-th shift register 214. That is, the p-th switch 218 and the pixel matrix 220 in this case are composed of N-type transistors.

Figure 2C:
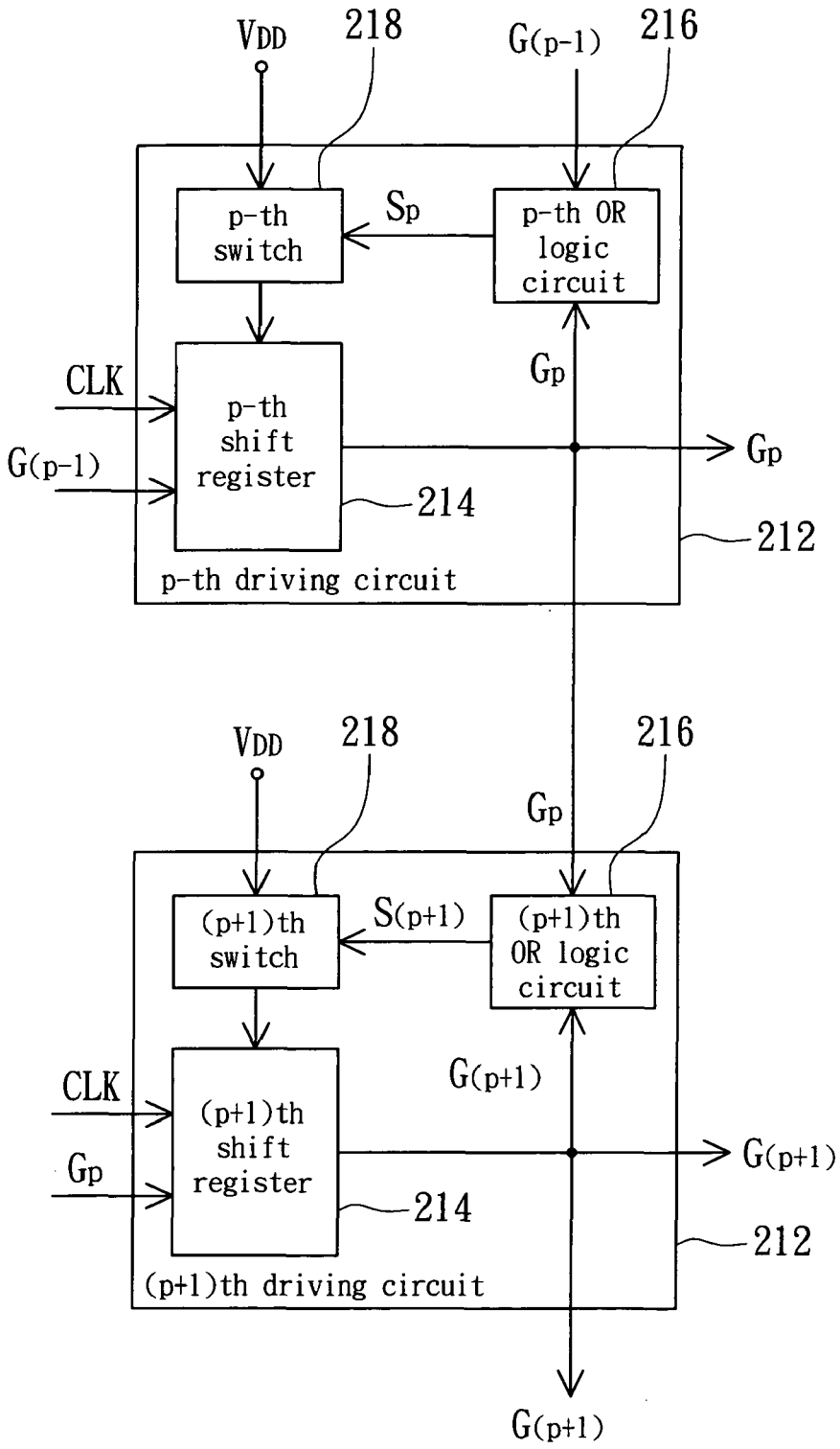
FIG. 2C is a block diagram showing circuits of the p-th driving circuit 212 and the (p+1)th driving circuit 212 coupled to each other in FIG. 2A.
Figure 2D:
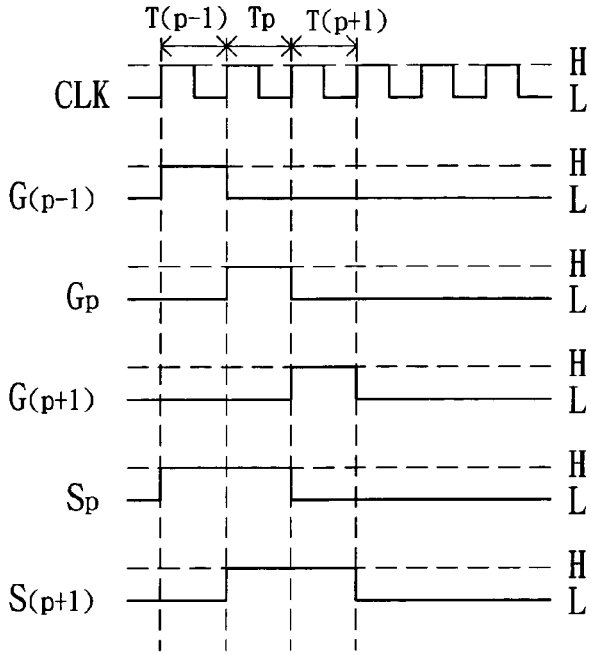
FIG. 2D is a timing chart showing the timings of the clock signal CLK, the gate pulses G(p−1), Gp and G(p+1), and the control signals Sp and S(p+1) in the liquid crystal display of FIG. 2A.

FIG. 2C is a block diagram showing circuits of the p-th driving circuit 212 and the (p+1)th driving circuit 212 coupled to each other in FIG. 2A. FIG. 2D is a timing chart showing the timings of the clock signal CLK, the gate pulses G(p−1), Gp and G(p+1), and the control signals Sp and S(p+1) in the liquid crystal display of FIG. 2A. Two arbitrary driving circuits such as the p-th (p≧2) driving circuit 212 and the (p+1)th driving circuit 212 coupled to each other will be illustrated as an example. According to the clock signal CLK outputted by the timing controller 240, the gate pulse G(p−1) outputs a high voltage level H (~VDD) and the p-th driving circuit 212 and the (p+1)th driving circuit 212 have no signal output in the timing period T(p−1). That is, the gate pulses Gp and G(p+1) are at low voltage levels L (=0). At this time, the p-th OR logic circuit 216 in the p-th driving circuit 212 outputs the control signal Sp with the high voltage level H according to the gate pulses G(p−1) (H) and Gp(L), such that the p-th switch 218 is turned on and the p-th shift register 214 is thus enabled. Thus, the p-th shift register 214 is powered on by the operation voltage VDD, and continues outputting the gate pulse Gp with the low voltage level L according to the clock signal CLK and the gate signal G(p−1) (L).

Meanwhile, the (p+1)th OR logic circuit 216 in the (p+1)th driving circuit 212 outputs a control signal S(p+1) with the low voltage level L according to the gate pulses Gp(L) and G(p+1) (L), such that the (p+1)th switch 218 is turned off. Because the operation voltage VDD cannot be inputted to the (p+1)th shift register 214, the gate pulse G(p+1) continues outputting the low voltage level L.

Next, in the timing period Tp, the p-th switch 218 is turned on and the operation voltage VDD may be inputted to the p-th shift register 214. Because the gate pulse G(p−1) still has the high voltage level H and is not lowered to the low level L at the moment as the clock signal CLK is boosted from the low level L to the high level H, the p-th shift register 214 detects the gate pulse G(p−1) with the high level H and outputs the gate pulse Gp with the high voltage level H. The p-th OR logic circuit 216 in the p-th driving circuit 212 continues outputting the control signal Sp with the high voltage level H according to the gate pulses G(p−1) (L) and Gp(H), such that the p-th switch is kept ON and the p-th shift register 214 is kept at the enabled state. At this time, the (p+1)th driving circuit 212 still has no signal output yet. That is, the gate pulse G(p+1) still has the low voltage level L. Thus, the (p+1)th OR logic circuit 216 in the (p+1)th driving circuit 212 outputs the control signal S(p+1) with the high voltage level H according to the gate pulses Gp(H) and G(p+1) (L), such that the (p+1)th switch 218 is turned on. Consequently, the (p+1)th shift register 214 is powered on by the operation voltage VDD and continues outputting the gate pulse G(p+1) with the low voltage level L according to the clock signal CLK and the gate signal Gp.

Next, in the timing period T(p+1), the gate pulse G(p−1) continues outputting the low voltage level L. The p-th shift register 214 in the p-th driving circuit 212 outputs the gate pulse Gp with the low voltage level L according to the clock signal CLK and the gate signal G(p−1) (L). The p-th OR logic circuit 216 outputs the control signal Sp with the low voltage level L according to the gate pulses G(p−1) (L) and Gp(L), such that the p-th switch 218 is turned off and the p-th shift register 214 is disabled. At this time, the (p+1)th switch 218 is still ON. Because the gate pulse Gp still has the high voltage level H and is not lowered to the low level L yet at the moment as the clock signal CLK is boosted from the low level L to the high level H, the (p+1)th shift register 214 detects the gate pulse Gp with the high level H and outputs the gate pulse G(p+1) with the high voltage level H. Thus, the (p+1)th OR logic circuit 216 in the (p+1)th driving circuit 212 outputs the control signal S(p+1) with the high voltage level H according to the gate pulses Gp(L) and G(p+1) (H), such that the (p+1)th switch 218 is still kept ON and the (p+1)th shift register 214 is stilled kept enabled.

Analogically, it ican be known that the switch 218 (the p-th switch 218) in each class of driving circuit 212 is ON in only two timing periods (T(p−1) and Tp), and OFF in other timing periods. Alternatively, only the switches 218 (the p-th and (p+1)th switches) of two driving circuits 212 are ON and the switches 218 of other driving circuits 212 are OFF in the same timing period (Tp). Thus, the operation voltage VDD cannot be inputted to the shift register 214 of each class of driving circuit 212 in the timing period when the corresponding switch 218 is OFF. So, it can reduce the leakage current generated by the shift register, and effectively reduce the power consumption of the liquid crystal display 200.

Figure 2E:
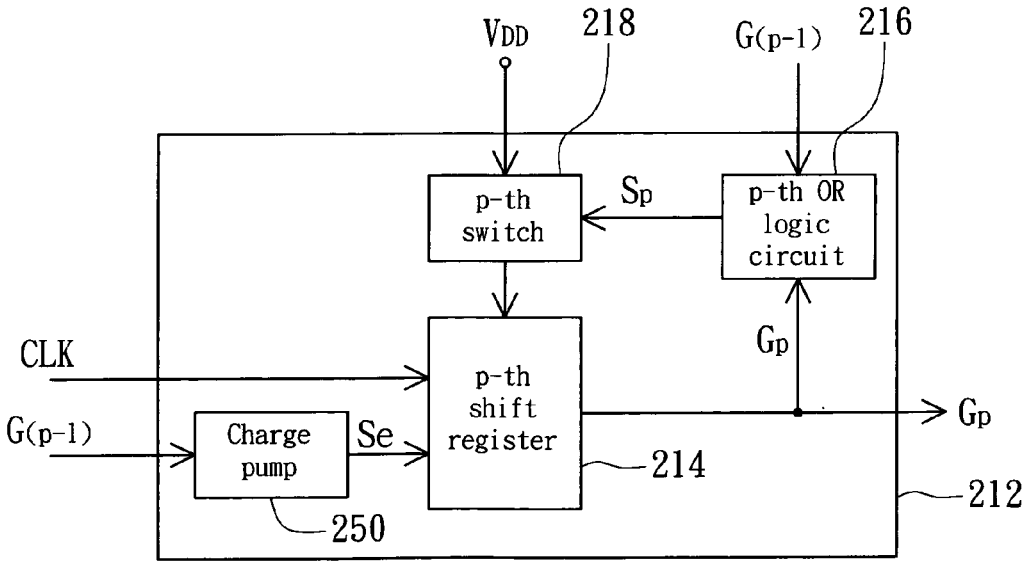
FIG. 2E is a block diagram showing circuits of the driving circuit with a charge pump according to the preferred embodiment of the invention.

FIG. 2E is a block diagram showing circuits of the driving circuit 212 with a charge pump according to the preferred embodiment of the invention. The p(1≦p≦n) driving circuit 212 further includes a charge pump 250, which is coupled to the p-th shift register 214, for outputting a voltage amplifying signal Se according to the gate pulse G(p−1) (p≠1) or the start pulse STP (p=1). The p-th shift register 214 outputs the gate pulse Gp according to the clock signal CLK and the voltage amplifying signal Se. The high voltage level of the gate pulse Gp outputted by each conventional shift register 214 is (VDD-p×Vt), wherein Vt is the threshold voltage of the transistor in the shift register 214. That is, the output level of the gate pulse Gp descends from class to class.

Figure 3A:
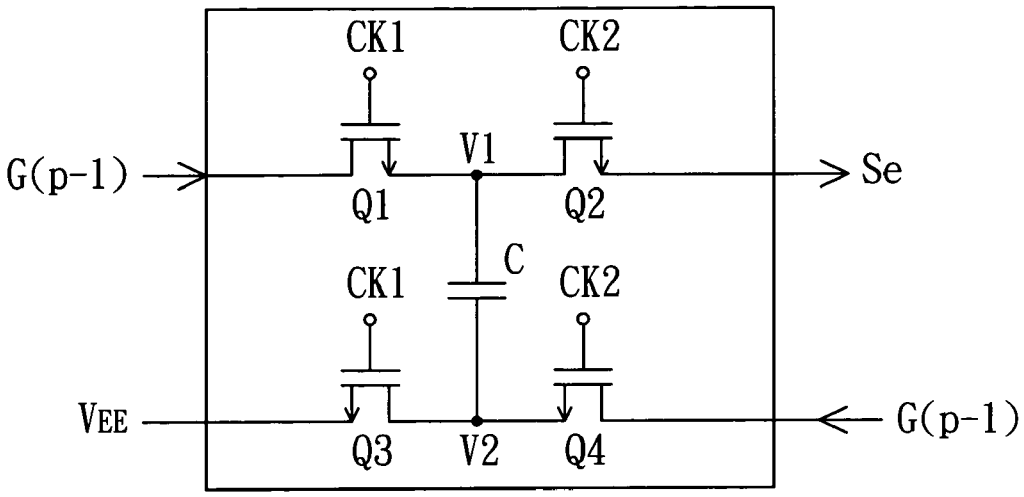
FIG. 3A is a diagram showing a circuit structure of the charge pump of FIG. 2E.

FIG. 3A is a diagram showing a circuit structure of the charge pump 250 of FIG. 2E. Referring to FIG. 3A, the charge pump 250 includes four NMOS transistors Q1, Q2, Q3 and 04 and a capacitor C. A clock signal CK1 is inputted to gates of the transistors Q1 and Q3, and a clock signal CK2 is inputted to gates of the transistors Q2 and 04. In addition, the gate pulse G(p−1) is inputted to drains of the transistors Q1 and Q4, and a voltage VEE is inputted to a source of the transistor 03. Hereinafter, the voltage VEE=0 will be illustrated as an example.

Figure 3B:
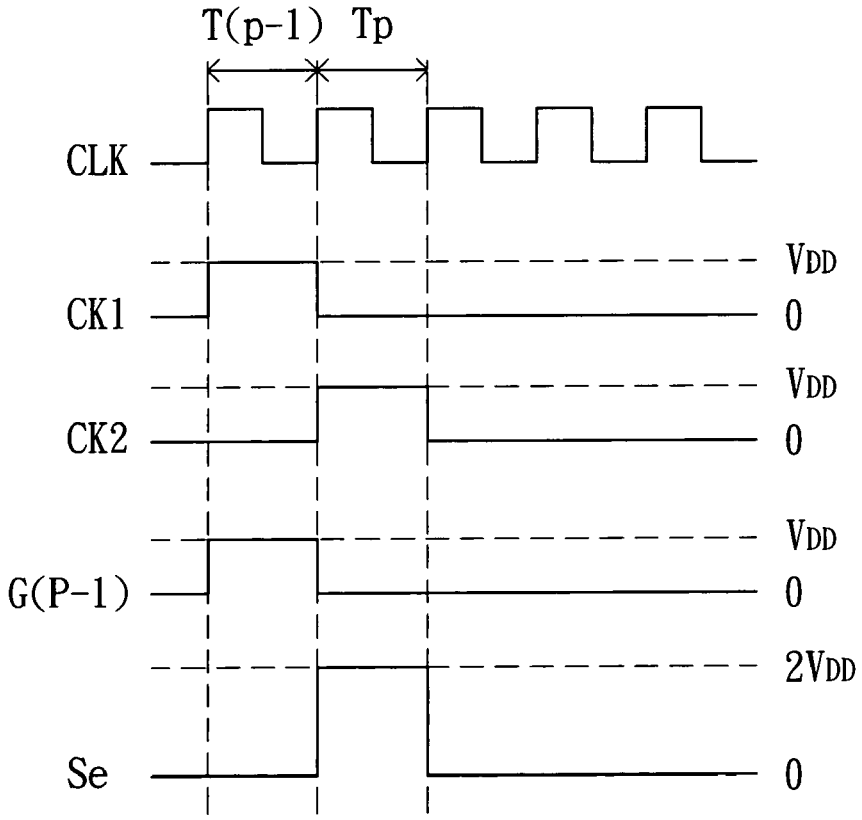
FIG. 3B is a timing chart showing the timings of the gate pulse G(p−1), the voltage amplifying signal Se, and the clock signals CLK, CK1 and CK2.

FIG. 3B is a timing chart showing timings of the gate pulse G(p−1), the voltage amplifying signal Se, and the clock signals CLK, CK1 and CK2. In the timing period T(p−1), the gate pulse G(p−1) outputs a high level (VDD) voltage. At this time, the clock signal CK1 outputs a high-level voltage (VDD) and the clock signal CK2 outputs a low-level voltage (0) such that the transistors Q1 and Q3 are turned on and the transistors Q2 and 04 are turned off. Thus, the signal Se outputs the low level (0), and the terminal voltage V1=VDD and the terminal voltage V2=VEE=0. So, the capacitor C stores a voltage drop of VDD.

Next, in the timing period Tp, the clock signal CK1 outputs the low level (0) and the clock signal CK2 outputs the high level (VDD), such that the transistors Q1 and Q3 are turned off and the transistors Q2 and 04 are turned on. At this time, the terminal voltage V2=VDD, and the terminal voltage V1 is boosted to 2VDD due to the VDD voltage previously stored in the capacitor C. Thus, the signal Se outputs the 2VDD voltage. However, because the turned on transistors Q1 to Q4 has a voltage drop, the output level of the signal Se is actually smaller than 2VDD and equal to about 1.5VDD. So, using the design of the charge pump 250 can boost the output of the signal Se to 1.5VDD, such that the shift register 214 can output the gate pulse Gp approximating the high level VDD according to the clock signal CLK and the voltage amplifying signal Se, and the problem of the output level descending of the gate pulse Gp from class to class can be avoided. That is, the charge pump 250 and the pixel matrix 220 are both composed of N-type transistors.

The advantage of the liquid crystal display disclosed in the embodiment of the invention will be described in the following. Each class of driving circuit controls the turn on or turn off of the shift register according to the output signal of the former class of driving circuit and the output signal of this class of driving circuit, such that the shift register in the same driving circuit is turned on in only two timing periods, or the shift registers in only two driving circuits are turned on in the same timing period. Thus, it can reduce the leakage current generated in each class of shift register, and the power-saving effect of the liquid crystal display may be achieved.

The p-th switch 218 of FIG. 2B may also be replaced by a PMOS transistor. In this case, the p-th OR logic circuit 216 is replaced by a NOR logic circuit, and the p-th switch 218 and the pixel matrix 220 are composed of P-type transistors. In addition, it is also possible to move the p-th switch (N-type transistor) 218 of FIG. 2B to the position between the p-th shift register and the ground, and the operation principle is the same as that shown in FIG. 2B. When the p-th switch 218 is moved to the position between the p-th shift register and the ground, it may also be replaced by a P-type transistor. At this time, the p-th OR logic circuit 216 is replaced by a NOR logic circuit.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A gate driver, comprising:

a first driving circuit, comprising:

a first shift register for outputting a first gate pulse according to a first voltage amplifying signal;

a first logic circuit for outputting a first control signal according to a starting signal and the first gate pulse; and a first switch for controlling enablement of the first shift register by controlling whether an operation voltage is input to the first shift register according to the first control signal; and a first charge pump, coupled to the first shift register, for outputting the first voltage amplifying signal according to the starting signal; and a second driving circuit, coupled to the first driving circuit, the second driving circuit comprising:

a second shift register for outputting a second gate pulse according to a second voltage amplifying signal;

a second logic circuit for outputting a second control signal according to the first gate pulse and the second gate pulse; and a second switch for controlling enablement of the second shift register by controlling whether the operation voltage is input to the second shift register according to the second control signal; and a second charge pump, coupled to the second shift register, for outputting the second voltage amplifying signal according to the first gate pulse.

2. The gate driver according to claim 1, wherein the starting signal is a third gate pulse outputted by the gate driver, or a start pulse outputted by a timing controller.

3. The gate driver according to claim 1, wherein in a first timing period, the starting signal outputs a high voltage level, the first gate pulse and the second gate pulse output a low voltage level, the first control signal enables the first shift register, and the second shift register is disabled.

4. The gate driver according to claim 3, wherein in a second timing period, the starting signal outputs the low voltage level, the first gate pulse outputs the high voltage level, the second gate pulse outputs the low voltage level, and the first control signal and the second control signal enable the first shift register and the second shift register, respectively.

5. The gate driver according to claim 4, wherein in a third timing period, the starting signal and the first gate pulse output the low voltage level, the second gate pulse outputs the high voltage level to disable the first shift register, and the second control signal enables the second shift register.

6. The gate driver according to claim 1, wherein: the second charge pump is coupled between the first shift register and the second shift register.

7. A gate driver, comprising:

a first shift register for outputting a first gate pulse according to a first voltage amplifying signal;

a first switch for controlling enablement of the first shift register by controlling whether an operation voltage is input to the first shift register according to a starting signal and the first gate pulse;

a first charge pump, which is coupled to the first shift register, for outputting the first voltage amplifying signal according to the starting signal;

a second shift register for outputting a second gate pulse according to a second voltage amplifying signal;

a second switch for controlling enablement of the second shift register by controlling whether the operation voltage is input to the second shift register according to the first gate pulse and the second gate pulse; and a second charge pump, which is coupled to the second shift register, for outputting the second voltage amplifying signal according to the first gate pulse.

8. The gate driver according to claim 7, wherein the starting signal is a third gate pulse outputted by the gate driver.

9. The gate driver according to claim 7, wherein in a first timing period, the starting signal outputs a high voltage level, and the first gate pulse and the second gate pulse output a low voltage level such that the first shift register is enabled and the second shift register is disabled.

10. The gate driver according to claim 9, wherein in a second timing period, the starting signal outputs the low voltage level, the first gate pulse outputs the high voltage level, and the second gate pulse outputs the low voltage level such that the first shift register and the second shift register are enabled.

11. The gate driver according to claim 10, wherein in a third timing period, the starting signal and the first gate pulse output the low voltage level, and the second gate pulse outputs the high voltage level, such that the first shift register is disabled and the second shift register is enabled.

* * * * *